US006701733B2

(12) United States Patent
Brunner

(10) Patent No.: US 6,701,733 B2
(45) Date of Patent: Mar. 9, 2004

(54) AIR CONDITIONING SYSTEM FOR MARINE APPLICATIONS

(76) Inventor: John R. Brunner, 4211 Colleyville Blvd., Colleyville, TX (US) 76034

( * ) Notice: Subject to any disclaimer, the term of this patent is extended or adjusted under 35 U.S.C. 154(b) by 0 days.

(21) Appl. No.: 10/215,796

(22) Filed: Aug. 9, 2002

(65) Prior Publication Data

US 2004/0007005 A1 Jan. 15, 2004

Related U.S. Application Data

(60) Provisional application No. 60/394,594, filed on Jul. 9, 2002.

(51) Int. Cl.[7] ..... B63B 25/26; F25D 23/12

(52) U.S. Cl. ..... 62/240; 62/260; 165/41; 165/44

(58) Field of Search ..... 62/240, 305, 428, 62/434, 435; 621/506, 260; 165/41, 43, 44

(56) References Cited

U.S. PATENT DOCUMENTS

| | | | | | |
|---|---|---|---|---|---|
| 3,802,214 | A | * | 4/1974 | Prieto | 62/240 |
| 4,069,788 | A | * | 1/1978 | Nitzki | 440/88 R |
| 4,922,724 | A | * | 5/1990 | Grayson et al. | 62/135 |
| 5,457,964 | A | * | 10/1995 | Hyde | 62/86 |
| 5,507,673 | A | * | 4/1996 | Boggia | 440/46 |
| 5,599,217 | A | * | 2/1997 | Ferrante | 440/88 R |
| 5,848,536 | A | * | 12/1998 | Dodge et al. | 62/240 |
| 6,029,463 | A | * | 2/2000 | Stenvinkel | 62/115 |
| 6,044,901 | A | * | 4/2000 | Basala | 165/122 |
| 6,263,689 | B1 | * | 7/2001 | Dodge et al. | 62/240 |
| 6,414,399 | B1 | * | 7/2002 | Bianchi | 290/1 A |
| 2002/0017108 | A1 | * | 2/2002 | Schooley | 62/240 |

FOREIGN PATENT DOCUMENTS

| | | | | | |
|---|---|---|---|---|---|
| JP | 362110597 | A | * | 5/1987 | 114/211 |

* cited by examiner

*Primary Examiner*—William E. Tapolcai
*Assistant Examiner*—Mohammad M. Ali
(74) *Attorney, Agent, or Firm*—Bracewell & Patterson, L.L.P.

(57) ABSTRACT

A marine air conditioning system for installation on a boat has a compressor, a water-cooled condenser, and an evaporator. The compressor is directly driven by an engine used for propelling the boat. The condenser is installed inline in a cooling-water intake tube, through which a pump draws water from outside of the hull for cooling the engine. Water from the intake tube is drawn through a portion of the condenser in thermal communication with the refrigerant for transferring heat from the refrigerant to the water. The water then continues into and through the engine and is exhausted through a discharge tube. The refrigerant then passes through an orifice or an expansion valve, and then into the evaporator. Air is passed through the evaporator for cooling the air, and the refrigerant returns to the compressor for recirculation in the system.

9 Claims, 1 Drawing Sheet

AIR CONDITIONING SYSTEM FOR MARINE APPLICATIONS

CROSS REFERENCE TO RELATED APPLICATIONS

Benefit is herein claimed of the filing date under 35 USC §119 and/or §120 and CFR 1.78 to U.S. Provisional Patent Application Serial No. 60/394,594, filed on Jul. 9, 2002, entitled "Air Conditioning System for Marine Applications."

BACKGROUND OF THE INVENTION

1. Field of the Invention

The present invention relates generally to marine air conditioning systems and relates specifically to a system having a water-cooled condenser.

2. Description of the Related Art

For many years, air conditioning units have been installed on boats to provide comfortable areas on the boat during warm weather. Various methods of cooling the air on the boat have been used, including non-refrigerant cooling systems. However, a system using a compressed refrigerant is the most effective system in widespread use today.

In typical marine air conditioning systems, an electric motor drives a compressor for compressing refrigerant within a closed-system. The refrigerant becomes heated as it is compressed, and it then passes through a condenser for cooling the refrigerant. The condenser may be an air-cooled unit, in which air passes over tubing in the condenser for drawing heat from the refrigerant as it passed through the condenser. Another type uses water to cool the refrigerant, in which a pump draws water through a hole in the hull of the boat and over the condenser tubes. Either method sufficiently cools the refrigerant.

One disadvantage of using the current systems is that the electric motor typically requires the boat to be docked and connected to an outboard electrical source or to have an onboard generator. Without a generator, the system cannot be used when the boat is away from a dock. A disadvantage of a water-cooled system is that the system requires a separate water pump to pass water through the condenser. A related disadvantage is the additional holes in the hull that are required for the inlet and outlet of the pump for the condenser.

Many systems are available that use engine-driven compressors for compressing the refrigerant. However, these systems also use air-cooled condensers or water-cooled condensers that utilize a water pump in addition to that providing water to cool the engine.

Therefore, there is a need for a marine air conditioning system having a water-cooled condenser and that eliminates the need for a separate water pump for the condenser and the associated additional holes in the hull. There is also a need for such a system that is operable while away from a dock.

BRIEF SUMMARY OF THE INVENTION

A marine air conditioning system for installation on a boat comprises a compressor, a water-cooled condenser, and an evaporator. The compressor is preferably directly driven by an engine used for propelling the boat. The condenser is installed inline in a cooling-water intake tube, through which a pump draws raw water from outside of the hull for cooling the engine. The raw water from the intake tube is drawn through a portion of the condenser in thermal communication with the refrigerant for transferring heat from the refrigerant to the water. The raw water then continues into the engine cooling system and is exhausted through a discharge tube. The refrigerant passes through an expansion valve, and then into the evaporator. Air is passed through the evaporator for cooling the air, and the refrigerant returns to the compressor for recirculation in the system.

BRIEF DESCRIPTION OF THE DRAWINGS

The novel features believed to be characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings.

DETAILED DESCRIPTION OF THE INVENTION

Figure 1:
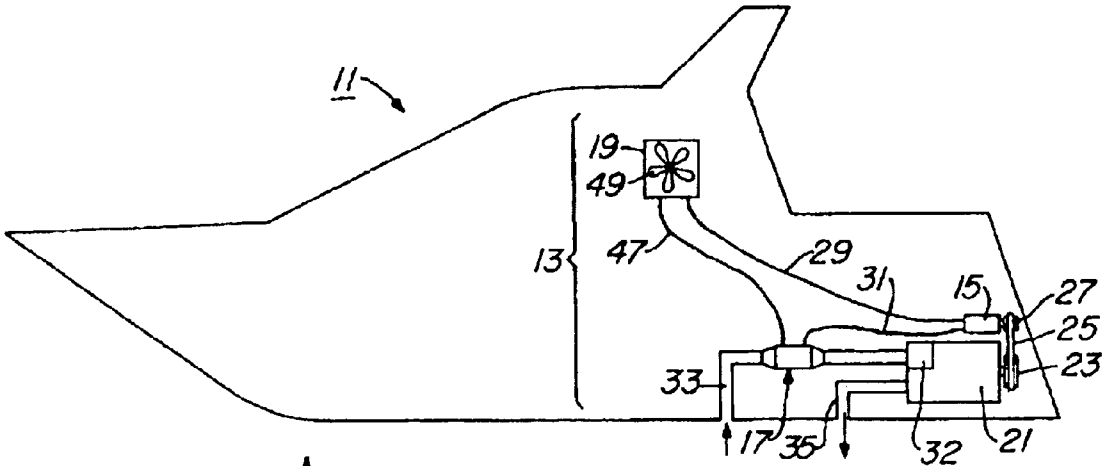
FIG. 1 is a schematic view of an air conditioning system according to the invention and installed on a boat.

FIG. 1 illustrates a boat 11 having an air conditioning system 13 installed thereon. System 13 is a sealed system containing a refrigerant (not shown) used in a refrigeration cycle. System 13 is engine-driven and water-cooled to provide cool air to a passenger cabin, helm, or other desired location on boat 11 without the need for an external power source to be connected to boat 11. The main components of system 13 are compressor 15, condenser 17, and evaporator 19.

Compressor 15 is mounted on or near engine 21. A belt pulley 23 on engine 21 is connected by belt 25 to a belt pulley 27 on compressor 15. When engine 21 is operating, pulley 23 rotates with engine 21, turning belt 25 and pulley 27. Pulley 25 is operably connected to a reciprocating piston (not shown), rotary valve, or other means located within compressor 15 for compressing the refrigerant within system 13. A clutch or other type of controller (not shown) selectively controls the output of compressor 15. The refrigerant enters compressor 15 through hose 29, which extends from evaporator 19, and exits compressor 15 through hose 31, which extends to condenser 17.

A pump 32, which may be driven by engine 21, as shown, or by other means, is used to draw raw water for cooling engine 21 into an intake tube 33, through engine 21, and out of discharge tube 35. Though shown as drawing water through a hole formed in the hull of boat 11, intake tube 33 may alternatively draw water from an outdrive portion of the propulsion system. Discharge tube 35 typically incorporates an outlet for exhaust gases from engine 21 and may discharge water through the hull, as shown, or at other locations on boat 11. Alternatively, water drawn through intake tube 33 may pass through a liquid-to-liquid heat exchanger for transferring heat from a separate, closed cooling system for engine 21, the raw water exiting out of discharge tube 35 without passing through engine 21.

Condenser 17 is installed in intake tube 33, the water passing through condenser 17 before passing through engine 21. The water cools the compressed refrigerant flowing through condenser 17 and cools engine 21 before exiting boat 11 through discharge tube 35. Though heat is transferred from the refrigerant to the water passing through condenser 17 prior to cooling engine 21, the amount of heat transferred does not interfere with cooling of engine 21. At least one oil cooler (not shown) or similar heat exchanger is typically located in intake tube 33, the coolers preferably being located downstream of condenser 17. This orientation allows cool intake water to first pass through condenser 17, increasing the coefficient of performance of system 13.

Figure 2:
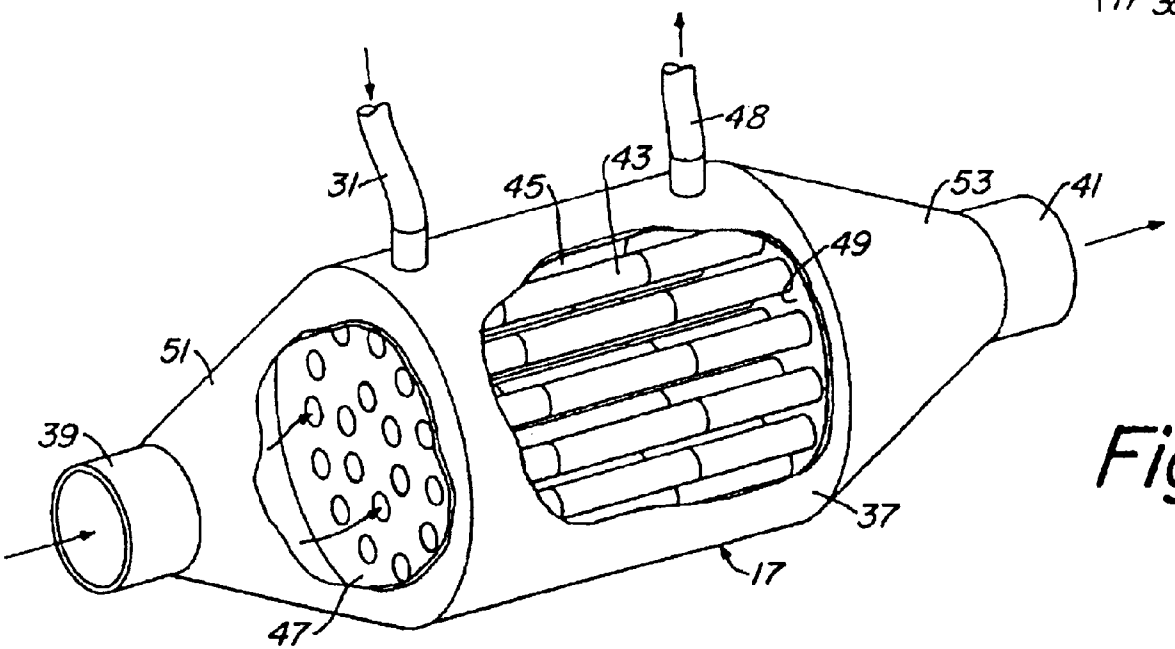
FIG. 2 is a perspective view of the condenser of FIG. 1.

FIG. 2 shows details of condenser 17. In the preferred embodiment, condenser 17 has a cylindrical outer body or housing 37, an inlet 39, and an outlet 41. Portions of outer housing 37 are shown removed, revealing tubes 43 located in interior volume 45 within housing 37. The walls of inlet 39 and outlet 41 are sealingly connected to header plates 47, 49, header plate 47 being visible near inlet 39. The ends of tubes 43 are connected to header plates 47, 49, creating a chamber, or manifold 51, 53, on each end of condenser 17. Manifold 51 communicates inlet 39 with tubes 43, and manifold 53 communicates tubes 43 with outlet 41, the plurality of tubes 43 providing multiple paths for water to flow between inlet 39 and outlet 41. Hose 31 and hose 48 are connected to housing 37 and communicate with volume 45 for passing refrigerant through volume 45 and around tubes 43. Having multiple tubes 43 provides for increased surface area for the thermal interface between the refrigerant in volume 45 and the water in tubes 43.

Referring again to FIG. 1, refrigerant passes from condenser 17 to evaporator 19 through hose 48. An expansion valve (not shown) is located before evaporator 19, the valve causing a pressure and temperature drop in the refrigerant. A fan 49 blows air across evaporator 19 for cooling the air through heat transfer to the refrigerant. The refrigerant exits evaporator 19 through hose 29 and flows to compressor 15 for recirculation in system 13.

In operation, engine 21 rotates pulley 23 and operates a water pump to move water into intake 33, through engine 21, and out of discharge 35. Belt 25 connects pulley 27 on compressor 15 to pulley 23, rotating pulley 27 as pulley 23 rotates. A reciprocating piston or other means, operated by pulley 27, compresses gaseous refrigerant contained in system 13. The temperature of the refrigerant increases as it is compressed.

The refrigerant flows through hose 31 from compressor 15 to condenser 17. Condenser is located inline with intake tube 33, through which the pump draws water for cooling engine 21. Water flows into condenser 17 through inlet 39, through tubes 43, and exits through outlet 41. Refrigerant flows from hose 31 into volume 45 and passes in and around tubes 43. Heat is transferred from the warmer, compressed, gaseous refrigerant to the cooler water through the sidewalls of tubes 43. In the embodiment shown, the heated water flows out of condenser 17, through engine 21, and into tube 35 for discharge into the surrounding water, though the water may alternatively flow through a liquid-to-liquid heat exchanger rather than through engine 21. Condenser 17 condenses the hot, gaseous refrigerant into a cooler, liquid refrigerant.

The cooled, liquid refrigerant flows from condenser 17 to evaporator 19 through hose 48. An expansion valve, located upstream of evaporator 19 and considered part of an evaporator assembly, causes a pressure and temperature drop in the refrigerant, converting the refrigerant to a cold gas. Fan 49 blows ambient air over evaporator 19, and heat is transferred from the air to the cold refrigerant. The cooled air is then circulated in selected areas of boat 11. The refrigerant flows out of evaporator 19 as a heated gas and into hose 29 for return to compressor 15 and recirculation through system 13. This cycle continues while compressor 15 and the water pump are operated by engine 21.

Many advantages are realized from using the present invention. The air conditioning system of the invention uses an engine-driven compressor and a water-cooled condenser to provide cool air to portions of a boat without the need for external power. The condenser is located in the intake for cooling water for the engine, and water is drawn through the condenser by the engine water pump, eliminating the need for a second pump. Existing water conduits for cooling the engine may be used to provide cooling water for the condenser, thus additional holes in the hull, which are undesirable, are not required.

While the invention has been shown in only one of its forms, it should be apparent to those skilled in the art that it is not so limited, but is susceptible to various changes without departing from the scope of the invention. For example, the condenser may have a different exterior shape or configuration for fluid flow, such as concentric tubes or a single serpentine or coiled tube. Also, the water pump and compressor may be driven by various means, e.g., shafts, gears, etc.

I claim:

1. In a boat having an engine and a raw-water pump that is driven directly by the engine for cooling the engine, the improvement comprising:

a refrigerant compressor driven by the engine;

a refrigerant condenser having a refrigerant passage and a raw-water passage in thermal communication with each other, the refrigerant passage having an inlet connected to an outlet of the compressor, the raw-water passage having an inlet connected to a raw-water intake port in a hull of the boat and an outlet connected to an inlet of the raw water pump for cooling the refrigerant, the raw water passage within the condenser being sealed so as to enable a suction created by the raw water pump to communicate through the condenser to the raw water intake port to draw raw water continuously through condenser as the raw water pump operates; and an evaporator assembly connected between an outlet of the refrigerant passage of the condenser and an inlet of the compressor for exchanging heat with ambient air in the boat.

2. The system of claim 1, wherein the condenser comprises:

a housing;

at least one tube within the housing, defining an inner passage and an outer passage that are sealed from each other; and wherein one of the passages acts as the raw-water passage and is connected to the raw-water intake port and the raw water pump; and the other of the passages acts as the refrigerant passage and is connected to the outlet of the compressor.

3. The system of claim 1, wherein the condenser comprises:

a housing, the housing enclosing a volume in fluid communication with the outlet of the compressor and the inlet of the evaporator, serving as the refrigerant passage for circulating refrigerant through the volume; and a plurality of tubes extending through the volume in communication with the raw water intake port and the raw water pump, serving as the raw water passage.

4. The system of claim 1, further comprising:

a pulley on the engine;

a pulley on the compressor; and a belt extending between the pulleys for directly driving the compressor with the engine.

5. A boat, comprising:

an engine;

a raw water pump directly driven by the engine for circulating raw water for cooling the engine;

an air conditioning compressor mounted to the engine;

a belt extending between a shaft of the engine and the compressor for driving the compressor with the engine;

a condenser housing;

at least one tube located in the condenser housing, defining an inner passage inside the tube, the housing defining an outer passage surrounding the tube, one of the passages being a refrigerant passage and the other of the passages being a raw water passage;

an upstream raw water intake conduit leading from a raw water intake port in a hull of the boat to an inlet of the raw water passage of the condenser;

a downstream raw water intake conduit leading from an outlet of the raw water passage to an intake of the raw water pump, the raw water passage in the condenser housing being sealed to the upstream and downstream raw water intake conduits to enable the raw water pump to create a suction that draws raw water from the raw water intake port to the raw water pump; and an evaporator having an inlet connected to an outlet of the refrigerant passage, the refrigerant passage having an inlet connected to the compressor.

6. The boat according to claim 5, wherein the inner passage comprises the raw water passage.

7. The boat according to claim 5, wherein said at least one tube comprises a plurality of parallel tubes connected between header plates mounted within the condenser housing.

8. A boat, comprising:

an engine assembly;

a heat exchanger having a refrigerant passage and a raw water passage that are sealed from but in thermal communication with each other to exchange heat;

a refrigerant compressor driven by the engine assembly;

a refrigerant inlet conduit leading to an inlet of the refrigerant passage of the heat exchanger;

a refrigerant evaporator;

a refrigerant outlet conduit leading from an outlet of the refrigerant passage of the heat exchanger to the evaporator;

an upstream raw water intake conduit leading from an intake port in a hull of the boat to an inlet of the raw water passage;

a downstream raw water intake conduit leading from an outlet of the raw water passage;

means driven by the engine and in communication with the downstream raw water intake conduit for creating a suction at the intake port for drawing a stream of water through the upstream raw water intake conduit, raw water passage, and downstream raw water intake conduit for cooling the engine assembly and exchanging heat with refrigerant flowing through the refrigerant passage.

9. The boat according to claim 8, wherein the heat exchanger comprises a housing containing a plurality of parallel tubes extending between header plates.

* * * * *